United States Patent [19]

Jamgotchian

[11] 4,390,232

[45] Jun. 28, 1983

[54] MAGNETIC ELECTRICAL CONNECTOR

[76] Inventor: George H. Jamgotchian, 2769 West Mesa, Fresno, Calif. 93711

[21] Appl. No.: 181,688

[22] Filed: Aug. 27, 1980

[51] Int. Cl.[3] ..... H01R 11/11

[52] U.S. Cl. ..... 339/224; 339/12 R

[58] Field of Search ..... 339/10, 45 R, 263 B, 339/224–240, 29 B, 12

[56] References Cited

U.S. PATENT DOCUMENTS 3,750,083 7/1973 Fayling ..... 339/12 R 4,210,373 7/1980 McGee ..... 339/12 R X

*Primary Examiner*—Eugene F. Desmond

*Attorney, Agent, or Firm*—Harvey B. Jacobson

[57] ABSTRACT

A magnetic electrical connector utilizable to complete an electrical connection between an internal combustion engine and a battery includes a pair of hollow sleeves constructed of magnetic material and connected together by a magnet. One of the hollow sleeves is attached to a battery cable while the other sleeve is fixedly secured to one of the battery posts, and a long magnet is then positioned within both of the sleeves to complete the electrical connection. The sleeves may be of any desired shape, such as cylindrical, square and the like, while the connecting magnets will be similarly shaped so as to conformingly fit within the sleeves, and spring arms may be positioned on the sleeves to provide an additional means of holding the magnets in place. Additionally, a magnet may be attached directly to a top mount battery post without the necessity of utilizing a sleeve by drilling a hole through the post into which the magnet may be inserted. The construction of the magnetic electrical connector permits a rapid manual disconnection of a battery without the necessity of utilizing any tools.

11 Claims, 6 Drawing Figures

MAGNETIC ELECTRICAL CONNECTOR

BACKGROUND OF THE INVENTION

1. Field of the Invention

The present invention relates to an electrical connection arrangement for ignition systems of internal combustion engines, and more particularly pertains to a quick disconnect electrical connection arrangement for the battery cables of a battery associated with an internal combustion engine.

2. Description of the Prior Art

With respect to providing good electrical contacts between electrical connectors and their associated batteries, there has been recognized to some extent the advantage of utilizing magnets to effect such electrical connections. In this respect, U.S. Pat. No. 2,764,747, issued to H. Modrey on Sept. 25, 1956, discloses the use of magnets associated with flat blade and round pin connectors in electrical circuits to facilitate a more efficient electrical contact. Specifically, Modrey relies primarily upon frictional contact between connectors, such frictional contact being achieved through a spring force exerted by the connectors themselves, and being supplemented through the use of magnetic material being crimped about one of the connectors and a small magnet being attached to the other of the connectors whereby a magnetic attraction between the magnet and the magnetic material assists in assuring a good electrical contact. However, the construction of the Modrey device is not adaptable to use with automobile batteries, nor is it designed as a quick disconnect arrangement in the manner of the present invention.

There has been at least one attempt to utilize a purely magnetic connection in an automotive electrical system. In this regard, U.S. Pat. No. 4,019,796, issued to Issler et al on Apr. 26, 1977, illustrates a separable contact and connection arrangement for ignition cables to a fixed terminal, such as a distributor cap of a distributor-breaker assembly. Issler et al achieves such a connection by securely fastening a magnet to the end of an ignition cable, such magnet being magnetically engageable with a steel contact molded into a distributor cap. Some relative movement between the magnet and the electrical cable is permitted through the use of an assembly which includes a tensioned coil spring. The Issler et al arrangement is not utilizable with an automobile battery since it would be necessary to utilize batteries having connection posts constructed of a magnetizable material and these are not commercially available. Further, the Issler et al arrangement relies to a great extent upon the extended tubular sockets associated with a distributor cap for support of the connection arrangement. In this respect, the sockets substantially assist in maintaining the electrical connection and were they not present, such an electrical connection could not be maintained. As such, it would be functionally impossible to utilize the connection arrangement of Issler et al on an automotive battery.

SUMMARY OF THE INVENTION

The general purpose of the present invention, which will be described subsequently in greater detail, is to provide a quick disconnect electrical connection means for use in an automotive system that has all the advantages of similarly employed prior art devices and none of the above-described disadvantages. To attain this, the present invention utilizes a cylindrically-shaped sleeve constructed of magnetizable material and attachable to a conventional battery cable designed for connection to an automotive battery. A second cylindrically-shaped sleeve constructed of magnetizable material is attached to one of the connection parts of the battery, and a solid cylindrically-shaped magnet has respective ends thereof inserted into the two afore-described sleeves thereby to effect a connection therebetween. Alternatively, the sleeves may be varied in shape, such as square or the like, as long as the magnet employed is similarly shaped. Further, spring arms may be utilized on the sleeves to provide an additional means of retaining a magnet therein, while the sleeve associated with the battery post may be eliminated entirely by drilling a hole through the battery post and inserting the magnet directly therein.

It is therefore an object of the present invention to provide a quick disconnect electrical connection means which has all of the advantages of the prior art connection means and none of the disadvantages.

It is another object of the present invention to provide an electrical connection means which may be easily and economically manufactured.

It is a further object of the present invention to provide an electrical connection means which utilizes a magnet as the sole means of achieving such an electrical connection.

Still another object of the present invention is to provide an electrical connection means which is designed for use with a battery associated with an internal combustion engine.

Yet another object of the present invention is to provide an electrical connection means which eliminates the problem of loose battery connections.

Even another object of the present invention is to provide an electrical connection means which is not affected by vibration and which does not require any special tools to either connect or disconnect the same.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
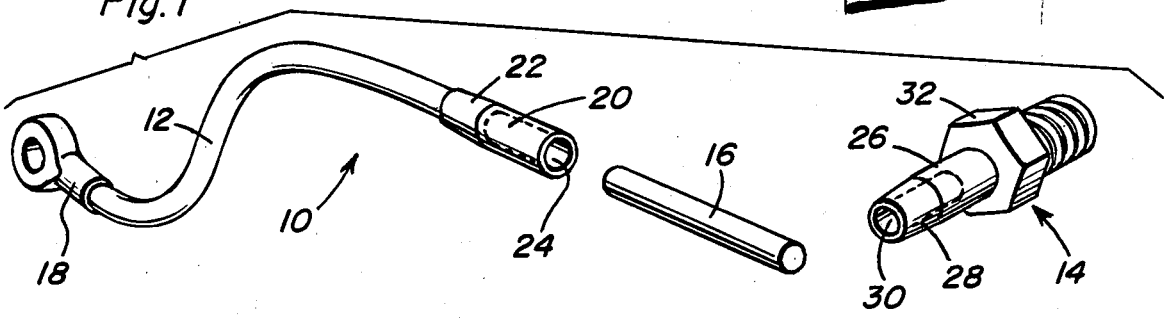
FIG. 1 is an exploded perspective view of the electrical connection means forming the present invention.

Referring now to the drawings and, in particular, to FIG. 1 wherein there is illustrated in detail a preferred embodiment of the present invention generally designated by the reference numeral 10. In this respect, the electrical connection means 10 includes a battery cable 12, a battery terminal connector 14 and a magnet 16 for effecting a connection between the battery cable and the terminal connector. The battery cable 12 includes a first connector 18 fixedly secured to one end of the cable and a second connector 20 fixedly secured to the other end of the cable. The first connector 18 is of a conventional construction and essentially consists of a ring-shaped member through which a bolt or terminal is insertable to effect a connection between the battery cable 12 and an engine ground, an engine starter or the like. The second connector 20 consists of a cylindrically-shaped metallic member constructed of magnetic material which, if desired, may have a beveled end 22 and which is fixedly secured to the cable 12, and further includes a tubular pocket 24 formed therein for receiving an end of the magnet 16.

Similarly, the battery terminal connector 14 includes a cylindrically-shaped metallic portion 26 formed of a magnetic material and having an optional beveled end 28 and a tubular pocket 30 for receiving the other end of the magnet 16. The metallic portion 26 is fixedly secured by welding or other means to the top of a bolt 32 in the manner clearly illustrated in FIG. 1.

Figure 2:
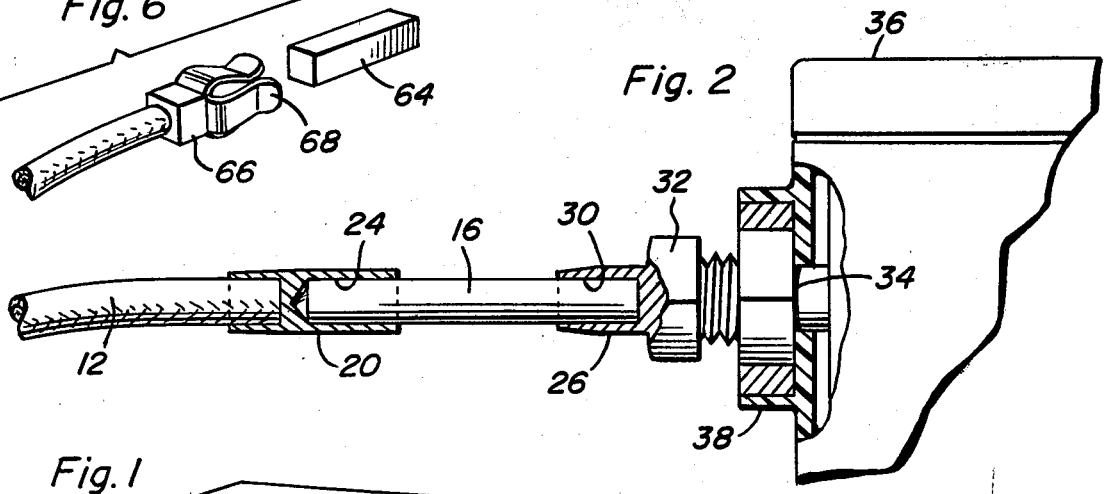
FIG. 2 is a longitudinal view, partly in section, of the invention electrically connected to a side-mount battery.

Referring now to FIG. 2 of the drawings, it can be seen that the bolt 32 may be screwably attached to the connection means 34 moldably secured in a side-mount battery 36. In this regard, the side-mount battery 36 is of conventional construction and is typically provided with electrical connection means 34 fixedly secured within a cylindrically-shaped extension 38. Further illustrated in FIG. 2 is the positioning of the magnet 16 within the tubular pocket 30 forming a part of the metallic portion 26 and within the tubular pocket 24 forming a part of the second connector 20 to thereby effect an electrical connection between the battery cable 12 and the battery terminal connector 14.

Figure 3:
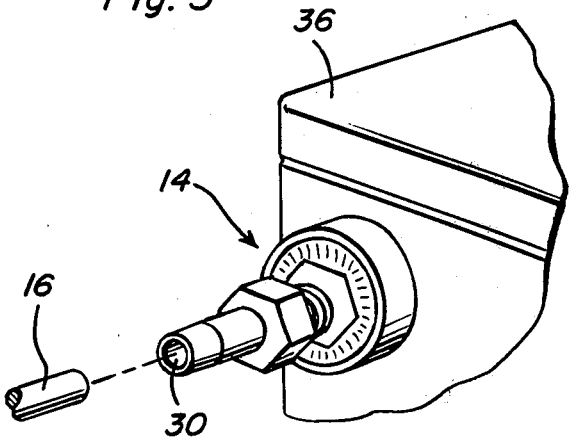
FIG. 3 is a perspective view illustrating further details of how the present invention is connected to a side-mount battery.

FIG. 3 is provided to illustrate the fact that the magnet 16 is slidably disposed within the tubular pocket 30 and that no means other than magnetic attraction between the magnet and the magnetic material of the terminal connector 14 is employed to secure the battery cable 12 to the side-mount battery 36. Similarly, the other end of the magnet 16 is slidably disposed within the tubular pocket 24 to magnetically retain the battery cable 12 in engagement therewith. As such, it can be appreciated that the magnet 16 is separable both from the second connector 20 and the battery terminal connector 14 as clearly illustrated in FIG. 1.

Figure 4:
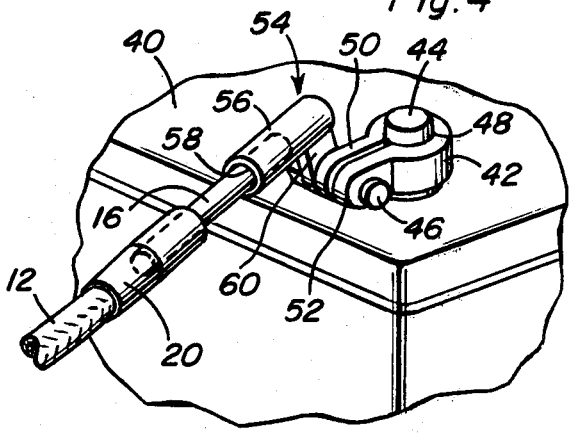
FIG. 4 is a perspective view of a slightly modified form of the present invention which permits a connection of the same to a top-mount battery.

FIG. 4 illustrates a modified embodiment of the present invention which permits an attachment of the same to a top-mount battery 40. Specifically, it can be seen that a solderless battery terminal 42 may be mounted about a battery connection post 44, such terminal including a bolt 46 for effecting a gripping engagement with the post in a conventional manner. In this respect, the solderless terminal 42 is of a conventional, commercially available construction and is of the type normally designed for attachment to a battery cable to facilitate the attachment of such cable to a battery post. As is apparent, the terminal 42 is of a circular split construction and includes an aperture 48 through which the battery connection post 44 is insertable. The bolt 46 is threadably positioned through a pair of spaced-apart extensions 50, 52 and may be utilized to effectively draw the extensions towards one another to facilitate a gripping engagement of the terminal 42 about the post 44, thereby establishing a firm electrical contact between the terminal and the post.

To facilitate the use of the present invention with the top-mount battery 40 illustrated in FIG. 4, a modified terminal connector 54 is used, such connector being constructed of a magnetic material and including a cylindrically-shaped portion 56 in which is contained a tubular pocket 58 for receiving the end of a magnet 16. Additionally, an off-set extension 60 is provided, such extension being integrally connected to the tubular portion 56 and having an aperture contained therein through which is insertable the bolt 46 to facilitate a connection of the terminal connector 54 to the solderless terminal 42. In this regard, the battery cable 12 is shown with the same kind of connector 20 as utilized in the first afore-described embodiment whereby the other end of the magnet 16 may be magnetically coupled thereto to complete the connection of the battery cable to the top-mount battery 40.

Figure 5:
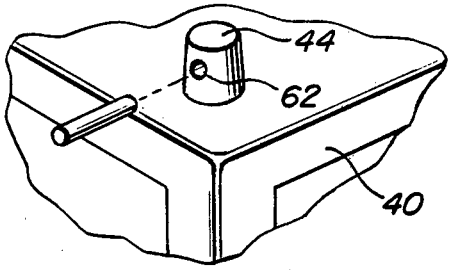
FIG. 5 is a perspective view illustrating a further means of attaching the present invention to a top-mount battery.

FIG. 5 illustrates a modification of the present invention whereby the solderless terminal 42 and terminal connector 54 can be eliminated. In this respect, a post 44 associated with a top-mount battery 40 may have an aperture 62 drilled therethrough and the afore-described magnet 16 may be directly inserted into the aperture to complete the electrical connection between the battery 40 and the battery cable 12.

Figure 6:
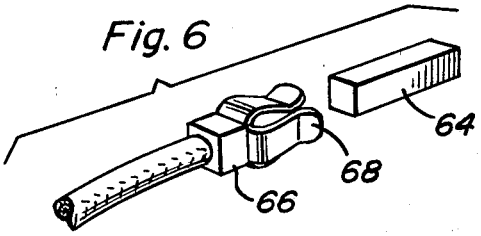
FIG. 6 perspective view of a slightly modified embodiment of the present invention whereby the sleeves and magnets associated therewith are of a square construction.

FIG. 6 illustrates a further modification of the present invention wherein a square-shaped magnet 64 is utilized in place of the cylindrically-shaped magnet 16. In this regard, a square-shaped sleeve 66 constructed of magnetic material is used to engage the magnet 64 and, if desired, the sleeve may be provided with spring engagement fingers 68 integrally constructed therewith so as to provide an additional gripping effect between the magnet and sleeve. Of course, only one sleeve 66 is illustrated and it is to be understood that the sleeve engaging the other end of the magnet 64 would also be square-shaped. Effectively then, the construction of FIG. 6 illustrates the fact that the magnets utilized, along with their engaging sleeves, may be of any form and shape as long as a conforming fit is provided for.

To utilize the embodiment of the present invention illustrated in FIG. 1, it is only necessary to threadably attach the battery terminal connector 14 to the connection means 34 moldably attached to a side-mount battery 36 in the manner illustrated in FIGS. 2 and 3, and then to position a magnet 16 within the tubular pocket 30. A battery cable 12 having a second connector 20 affixed thereto may then be slidably positioned over the magnet 16 whereby the magnet is guided into the tubular pocket 24 to complete an electrical connection. As can be appreciated, no special tools are required, such as wrenches or the like, since the magnet 16 serves as the sole means of connecting the battery cable 12 to the side-mount battery 36. Similarly, to attach the present invention to a top-mount battery 40, it is only necessary to attach a terminal connector 54 to a commercially available solderless terminal 42 in the manner illustrated in FIG. 4, and thence to effect a connection between a battery cable 12 and the terminal connector through the use of a magnet 16, such magnet being insertable within respective pockets 24, 58 contained on the battery cable and the terminal connector. Alternatively, the magnet 16 may be directly attached to the battery post 44 by inserting the magnet through an aperture 62 contained in the post.

As such, the present invention provides for a quick disconnect electrical connection between batteries and internal combustion engines which will not be substantially affected by engine vibration due to permissible relative movement between the battery cables and the terminal connectors. While the present invention has been shown in preferred embodiments for attachment to side-mount and top-mount batteries, the optimum dimensional relationships for the parts of the invention are deemed readily apparent and obvious to one skilled in the art, and all equivalent relationships to those illustrated in the drawings and described in the specification are intended to be encompassed by the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An electrical connection means, said means comprising:
   - a battery of the type utilized for supplying electrical energy to ignition systems such as for internal combustion engines;
   - a terminal connector attachable to said battery, said connector having a mating means;
   - a magnet having two ends, each end terminating in mating means, one end of which is engagingly positionable with said mating means of said terminal connector;
   - a battery cable for attachment to said terminal connector so as to facilitate the supplying of electrical energy to said internal combustion engine, said battery cable having a mating means fixedly secured at one end thereof, said mating means of the battery cable being engagingly positionable with one of the two ends of said magnet, and wherein each of said engaging mating means is constructed and arranged so that one mating means is receivably positionable with the other mating means.

2. The electrical connection means as defined in claim 1, wherein said magnet is of a separable construction and is attached to said battery cable and to said terminal connector solely by magnetic attraction.

3. The electrical connection means as defined in claim 1, wherein said battery cable is constructed of a magnetic responsive material and its mating means includes an aperture into which is insertable an end of said magnet so as to facilitate a magnetic connection.

4. The electrical connection means as defined in claim 1, wherein said terminal connector is constructed of a magnetic responsive material and is of a tubular shape having an aperture contained in the mating means therein for receiving mating means of said magnet to thereby facilitate a magnetic connection therebetween.

5. The electrical connection means as defined in claim 1, wherein said terminal connector includes a bolt fixedly attached thereto, said bolt being threadedly securable to said battery.

6. The electrical energy connection means as defined in claim 1, wherein said terminal connector includes a solderless terminal so as to facilitate the attachment of said terminal connector means to a post associated with said battery.

7. An electrical connection means, said means comprising:
   - a battery of the type utilized for supplying electrical energy to internal combustion engines;
   - a terminal connector attachable to said battery, said connector having an aperture longitudinally positioned therein;
   - a rod-shaped magnet having two ends, one end of which is positionable within said aperture of said terminal connector;
   - a battery cable for attachment to said terminal connector so as to facilitate the supplying of electrical energy to said internal combustion engine, said battery cable having a connector fixedly secured at one end thereof, said connector being an aperture positioned therein for receiving an end of said tubular-shaped magnet.

8. The electrical connection means as defined in claim 7, wherein said terminal connector comprises a bolt to which is attachable a tubular member having said terminal connector aperture contained therein, said bolt being screwably attachable to a side-mount battery.

9. The electrical connection means as defined in claim 7, wherein said terminal connector includes a solderless terminal, said solderless terminal being attachable to a battery post of a top-mount battery so as to facilitate an electrical connection between said battery cable and said battery.

10. An electrical connection means, said electrical connection means comprising:
   - an electrical energy supply means;
   - conductor means attachable to said electrical energy supply means for conducting electrical energy to and from said supply means;
   - magnetic connection means positionable between said electrical energy supply means and said conductor means for facilitating a connection between said conductor means and said supply means;
   - connector means fixedly secured to said conductor means and being magnetically attachable to said magnetic connection means; and
   - terminal connector means secured to said supply means and being magnetically attachable to said magnetic connection means, spring retention means provided on said connector means so as to provide an improved connection between said magnetic connection means and said connector means.

11. An electrical connection means, said electrical connection means comprising:
   - an electrical energy supply means;
   - conductor means attachable to said electrical energy supply means for conducting electrical energy to and from said supply means;
   - magnetic connection means positionable between said electrical energy supply means and said conductor means for facilitating a connection between said conductor means and said supply means;
   - connector means fixedly secured to said conductor means and being magnetically attachable to said magnetic connection means; and
   - terminal connector means secured to said supply means and being magnetically attachable to said magnetic connection means, said magnetic connection means comprising a square-shaped magnet having ends which are insertable into apertures contained respectively in said connector means and said terminal connector means.

* * * * *